US006099373A

United States Patent [19]

Fernstrum

[11] Patent Number: 6,099,373

[45] Date of Patent: Aug. 8, 2000

[54] OUTBOARD MARINE HEAT EXCHANGER

[75] Inventor: Todd S. Fernstrum, Menominee, Mich.

[73] Assignee: R.W. Fernstrum and Company, Menominee, Mich.

[21] Appl. No.: 09/059,376

[22] Filed: Apr. 14, 1998

[51] Int. Cl.[7] ..... B63H 21/10

[52] U.S. Cl. ..... 440/88; 165/44

[58] Field of Search ..... 440/88; 114/343; 165/44, 173, 175, 176

[56] References Cited

U.S. PATENT DOCUMENTS

| | | | |
|---|---|---|---|
| 1,838,722 | 12/1931 | Watson | 165/175 |
| 1,862,707 | 6/1932 | Rifenberick et al. | 165/175 |
| 2,466,525 | 4/1949 | Wilson | 440/88 |
| 4,015,555 | 4/1977 | Tinkham | 440/37 |
| 4,338,993 | 7/1982 | Fernstrum | 165/44 |

*Primary Examiner*—Ed Swinehart
*Attorney, Agent, or Firm*—Dickinson Wright PLLC

[57] ABSTRACT

An outboard marine heat exchanger comprises a plurality of cooling tubes positioned between opposing headers. Each header is equipped with a header flange having a plurality of fastening components. The fastening components are designed to mate with corresponding fastening components of a mating flange. In one embodiment, the mating flange interfaces with a pipe stub extending outwardly from a marine vessel hull. The header flange can then be attached to the mating flange to connect the heat exchanger to the cooling system of the vessel engine without the need to access the interior of the hull.

20 Claims, 3 Drawing Sheets

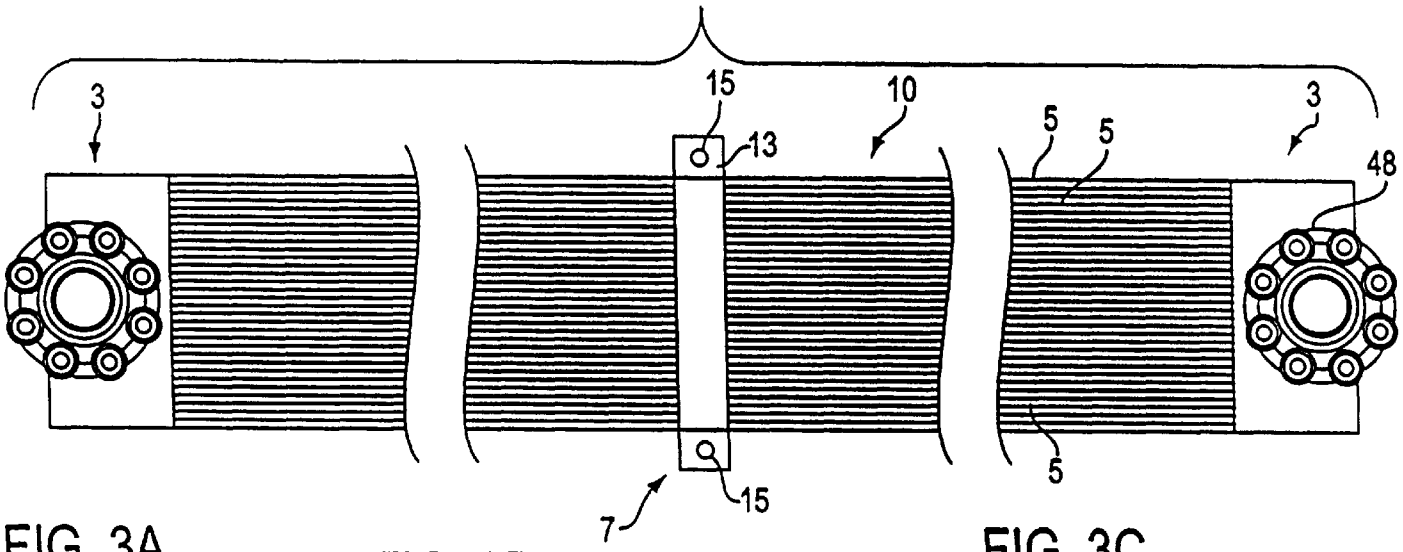
FIG. 1
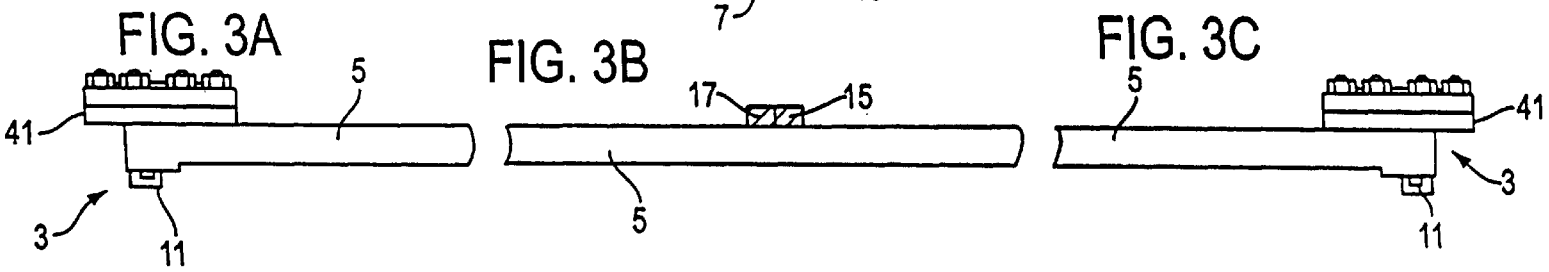
FIG. 3C
FIG. 3B
FIG. 3A
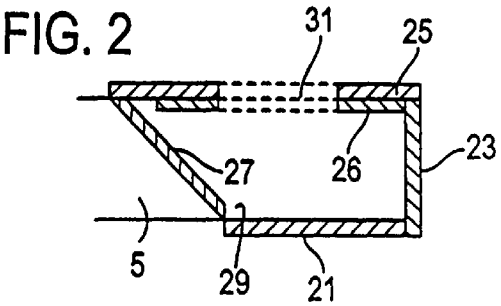
FIG. 2
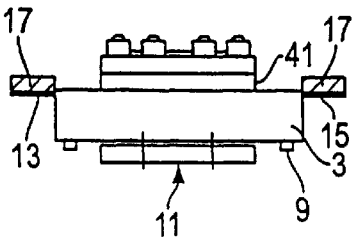
FIG. 4

OUTBOARD MARINE HEAT EXCHANGER

FIELD OF THE INVENTION

The present invention is directed to an outboard marine heat exchanger and, in particular, to a heat exchanger having an improved header configuration for easier mating with a marine vessel.

BACKGROUND ART

In the prior art, the use of outboard marine heat exchangers for cooling the coolant of marine engines is well-known. U.S. Pat. No. 4,338,993 to Fernstrum discloses one type of an outboard marine heat exchangers, this patent herein incorporated in its entirety by reference. In these types of heat exchangers, cooling tubes are interposed between water headers. Extending from each header is a nipple, the end of each nipple adapted to connect to hoses to provide communication with the marine engine cooling system. The nipples are threaded to receive a nut, the nut being used to secure the headers against the hull of a vessel.

One drawback associated with the heat exchangers described above relates to the incompatibility with double hull marine vessels that are being constructed or specified by customers with increasing frequency. The second or inner hull of these double hull vessels provides a safety feature should the integrity of the outer hull of the vessel be compromised. While these double hull marine vessels offer improvements in safety, they complicate the attachment of the prior art outboard marine heat exchangers thereto. More particularly, the threading of the nut onto the header nipple must be done between the double hulls, this area being difficult to access for either marine heat exchanger installation or removal.

Other marine vessels have isolation tanks or cofferdams to surround the heat exchanger coupling to the engine cooling system. The presence of these structures surrounding the nipple and nut of the marine heat exchanger also complicates the heat exchanger's installation and removal.

In view of the drawbacks in prior art heat exchangers noted above, a need has developed to provide an improved heat exchanger which is more easily secured to either a single hull or a double hull vessel. The present invention solves this need by providing a outboard marine heat exchanger which is easily adapted to single hull or double hull marine vessels.

SUMMARY OF THE INVENTION

Accordingly, it is a first object of the present invention to provide an improved outboard marine heat exchanger.

Another object of the present invention is to provide a heat exchanger which is easily installed on a marine vessel, particularly, double hull vessels.

A still further object of the present invention is to provide a method of attaching a heat exchanger to a marine vessel.

One other object of the present invention is to provide a improved heat exchanger header construction.

Other objects and advantages of the present invention will become apparent as a description thereof proceeds.

In satisfaction of the foregoing objects and advantages, the present invention provides, in one embodiment, a heat exchanger comprising a plurality of cooling tubes arranged in a spaced apart relationship and a pair of headers positioned at opposite ends of the plurality of cooling tubes. Each header further comprises a manifold chamber having a first set of openings in communication with one end of each of the cooling tubes and a second opening adapted to communicate with the engine cooling fluid of a marine vessel.

Each header has a flange attached to a portion thereof, the flange having a passageway therethrough to communicate with the manifold chamber of the header and the engine cooling fluid. The header flange has a plurality of fastening components to facilitate connecting the heat exchanger to a marine vessel.

The flange-containing heat exchanger interfaces with a mating flange assembly having a plurality of second fastening components. The mating flange fastening components are arranged or aligned to mate with the fastening components of the header flange to connect the mating flange to the header flange.

Electrical insulators can be provided between the mating flange and the header flange, both where surfaces of each face each other and at the mating of the fastening components.

In a preferred embodiment, the header flanges have threaded studs extending therefrom which engage openings in the mating flange. Nuts and washers can be used to secure the mating flange to the header flange studs. An electrically insulating washer can also be used to separate the stud from the mating flange and the nut and washer.

The mating flange can be attached to a pipe stub extending out from a vessel hull by welding or another form of attachment. The connection between the mating flange and header flange is sized and arranged so that the fastening connection therebetween can be made without interference from the vessel hull.

The invention also includes the assembly of the mating flange and the header flange as well as a method of installing the heat exchanger to a marine vessel.

BRIEF DESCRIPTION OF THE DRAWINGS

Reference is now made to the drawings of the invention wherein:

FIG. 1 is a top view of one embodiment of the heat exchanger assembly of the invention;

FIG. 2 is a cross sectional view of a portion of the heat exchanger of FIG. 1;

FIG. 3A is a side view of one end portion of the heat exchanger of FIG. 1;

FIG. 3B is a side view of a middle portion of the heat exchanger of FIG. 1;

FIG. 3C is a side view of another end portion of the heat exchanger of FIG. 1;

FIG. 4 is an end view of the FIG. 1 embodiment;

DESCRIPTION OF THE PREFERRED EMBODIMENTS

Figure 8:
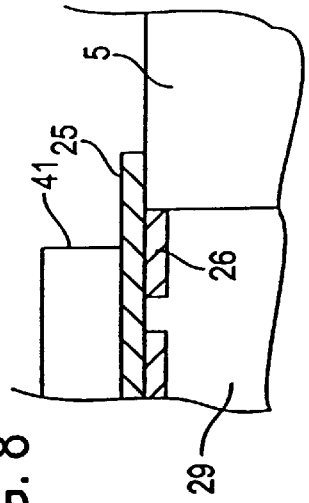
FIG. 8 is a partial sectional view of the embodiment of FIG. 7.

The present invention offers significant improvements in outboard marine heat exchangers. In contrast to the prior art marine heat exchangers, the inventive heat exchanger can easily interface with vessels having double hulls or vessels including containment structures surrounding the hull openings. Thus, in spite of the vessel construction, the invention achieves an easy interconnection between an engine cooling system and an outboard marine heat exchanger.

One embodiment of the invention is illustrated in FIGS. 1–5 and is generally designated by the reference numeral 10.

With particular reference to FIGS. 1, 3A–3C and 4, the inventive heat exchanger 10 includes a pair of headers 3 and a plurality of cooling tubes 5 arranged therebetween.

The FIG. 1 embodiment is shown with an intermediate support 7, drain plugs 9 extending from the bottom of the header 3 and a zinc electrode 11. The support 7 further comprises a plate 13 extending transversely across the cooling tubes 5. Each end of the plate 13 has a through opening 15 which facilitates attachment of the support 7 to a vessel hull. The intermediate support 7 is shown with gaskets 17 which electrically isolate the plate 13 of the heat exchanger 10 from the vessel.

An exemplary header design is depicted in FIG. 2 in cross sectional view. It should be understood that the header illustrated is exemplary and other header designs can be utilized as would be within the skill of the art.

The header 3 is shown with a bottom plate 21, an end plate 23, a top plate 25, a nipple plate 26 and an inclined cooling tube interface plate 27. The plate 27 has a plurality of openings which align with the open ends of the tubes 5. The plates when attached together to form a manifold chamber 29 which provides communication between the open ends of the cooling tubes 5 at the interface plate 27 and an opening 31 through the top plate 25 and the nipple plate 26. The various header plates can be attached together and to the tubes 5 in any known fashion, preferably by brazing.

Figure 5:
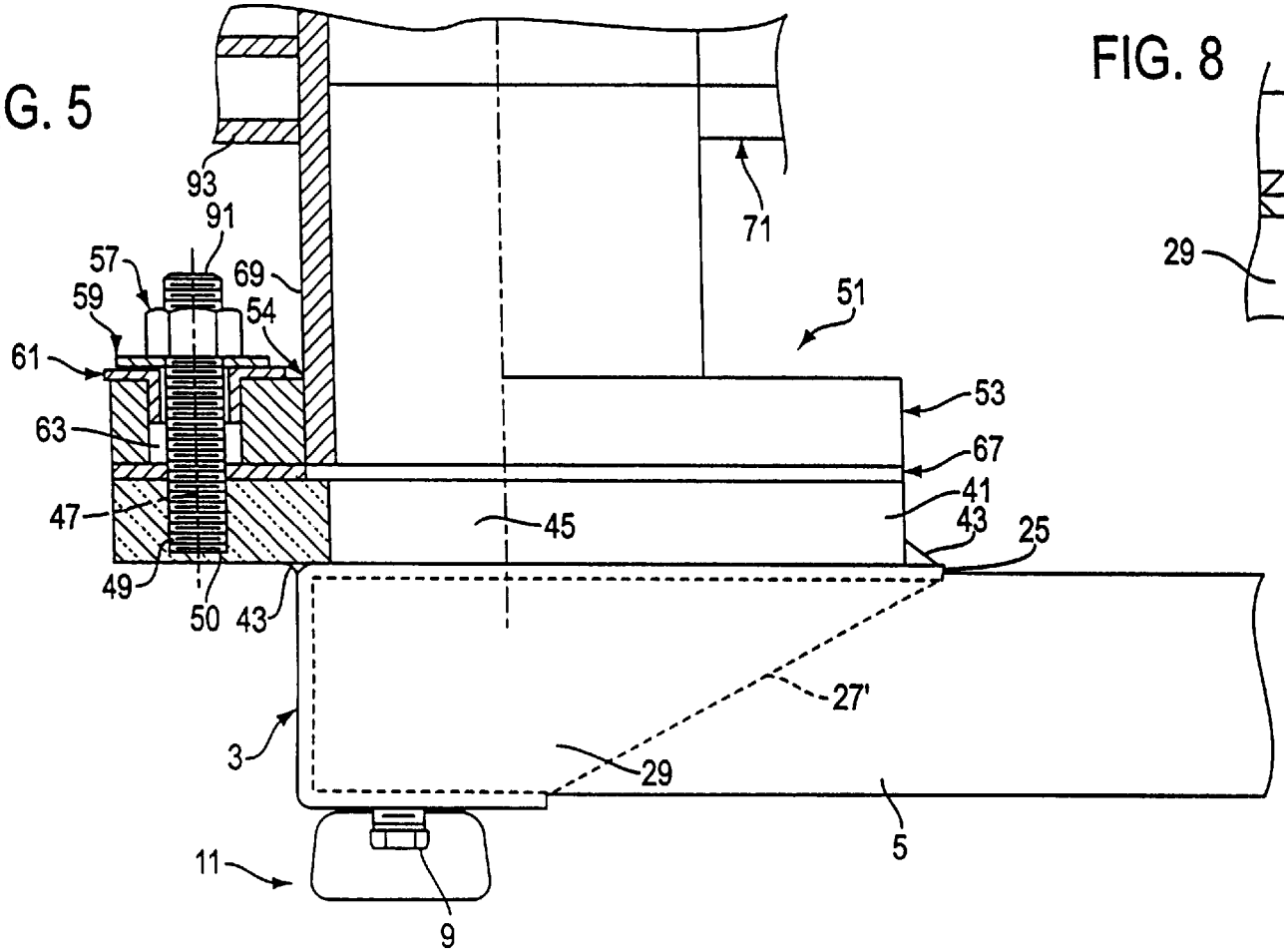
FIG. 5 is a cross sectional and a side view of another portion of the assembly of FIG. 1.

With reference to FIG. 5, the header 3 is shown with a header flange 41 welded thereto, the welds being depicted by reference numerals 43. The header flange 41 has an opening 45 therethrough that is aligned with the opening 31 through the header top plate 25 and the nipple plate 26.

Extending upwardly from the header flange 41 is a plurality of fastening components, depicted as threaded studs 47. The embodiment depicted in FIG. 1 shows eight threaded studs but more or less could be utilized depending on the size of the heat exchanger. Each threaded stud 47 can be either welded to the flange 41, threadably inserted into a blind tap 49, as shown in FIG. 5 or attached in another conventional manner. Using the blind tap 49 avoids boring through the flange 41. Instead, a thickness of flange material 50 remains at the base of the blind tap 49. In this way, the material 50 can prevent any inadvertent penetration of the top plate 25 by stud rotation where the threaded studs are positioned thereover, see for example, stud 48 of FIG. 1.

Each threaded stud 47 acts as a fastening component to facilitate attachment to a mating flange assembly 51. The mating flange assembly 51 comprises a mating flange 53 and another set of fastening components designed to interface with the fastening components of the header flange, e.g., a plurality of lock nuts 57, washers 59 and shoulder washers 61. The mating flange 53 has openings 63 bored therethrough, each opening 63 aligned with a respective threaded stud 47. The washers 59 and 61 and lock nuts 57 are then used to secure the mating flange 53 to the header flange 41.

While a threaded stud, nut and washer arrangement is disclosed, any mechanical fastening arrangement can be used to secure the mating flange 53 to the header flange 41 as would be within the skill of the art. For example, a bolt could be used which would be threaded in a complementary threaded bore in the header flange 41. As explained below, the fastening of the flanges requires the necessary clearance between the mating flange and a vessel hull 71.

The shoulder washers 61 provide electrical insulation between the threaded studs 47 and the mating flange assembly 51. This assures electrical isolation of the entire heat exchanger. Similarly, a gasket 67 is interposed between the flanges 53 and 41 to ensure electrical insulation between the mating flange 53 and the heat exchanger 10. The electrical insulation inhibits or prevents any galvanic corrosion of either the heat exchanger 10 or the hull 71.

The mating flange 53 as shown in FIG. 5 is secured to a pipe stub 69 which extends from the vessel hull 71. More particularly, the flange 53 has a passageway 54 which receives the stub 69 so as to permit cooling fluid to pass into or from the heat exchanger 10. The flange 53 can be attached to the pipe stub 69 in any conventional fashion, e.g., welding or the like. With the attachment between the pipe stub 69 and the mating flange 53, fluid communication is established between the engine cooling fluid system and the heat exchanger header manifold 29 and cooling tubes 5 via the pipe stub 69.

The arrangement of the pipe stub 69, the mating flange assembly 51 and the header flange 41 allows for attachment of the outboard marine heat exchanger 10 without having to access the interior of the marine vessel. This contrasts directly with prior art heat exchangers that require access to the hull interior for attachment.

Although the header flange 41 is shown as welded to the header 3, other metal fusion techniques or other modes of attachment are also within the scope of the invention. For example, the header flange could be mechanically fastened to the header 3. In another example, the header flange 41 could be threaded onto a threaded nipple extending upwardly from the header top plate 25.

In one other mode, the header flange 41 could be sized to replace the header top plate 25 so that it would function to both enclose the manifold 29 and mate with the flange 53. In yet another embodiment, if so desired, the mating flange 53 could have a pipe extending therefrom, this pipe adapted to either connect to a pipe stub extending from a vessel or engage a hull opening and be secured to the inside of the hull with a nut or the like. In this way, the mating flange 53 can be adapted for differently configured hulls.

The flanges 41 and 53 are preferably about an inch thick but various thicknesses can be used as would be within the skill of the art.

Figure 6:
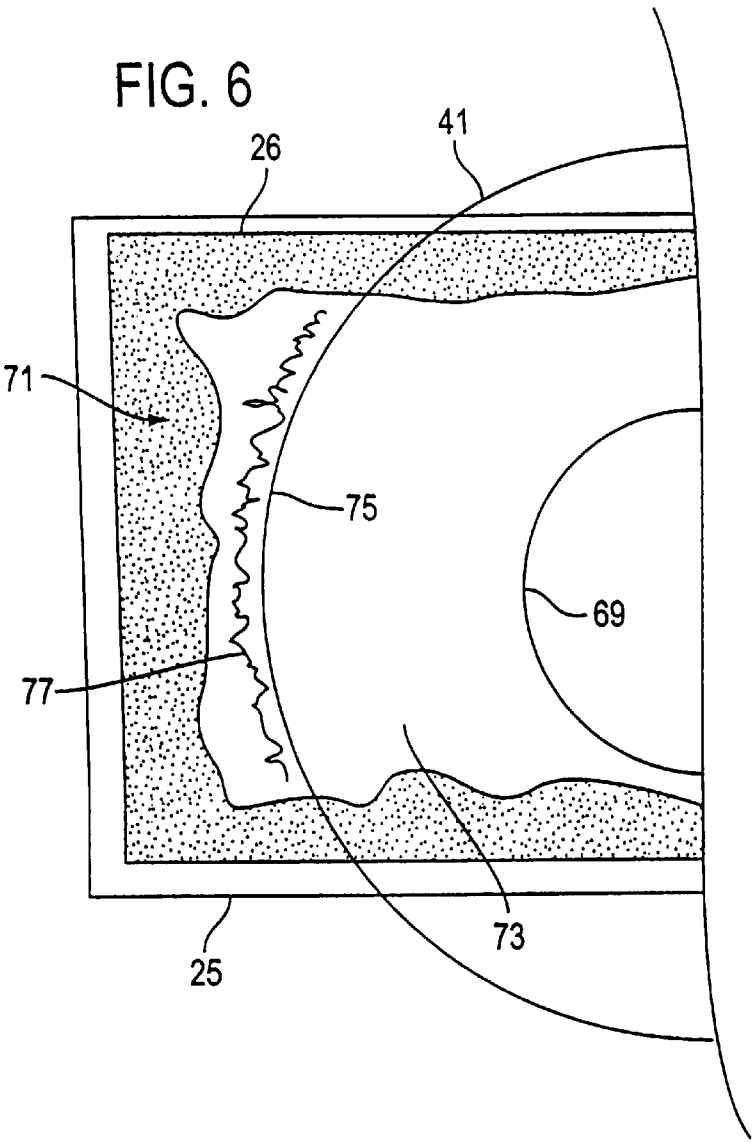
FIG. 6 is an overview of a portion of a heat exchanger showing a potential failure zone.

With reference to FIG. 6, a preferred mode of installing the header flange 41 is depicted. First, given that the flange 41 can be much thicker than the header top plate 25 and nipple plate 26, e.g., 1" thick versus ⅛ or 1/16' thick, premature failure can occur where the header flange 41 is secured to the header top plate 25. This premature failure can occur as a result of insufficient attachment, e.g., a brazing connection, between the nipple plate 26 and the header top plate 25. More particularly, when brazing for example. The silver used as part of the brazing process can fail to penetrate the zone between the top plate 25 and the nipple plate 26 where a periphery of the header flange is secured to the top plate 25.

Figure 7:
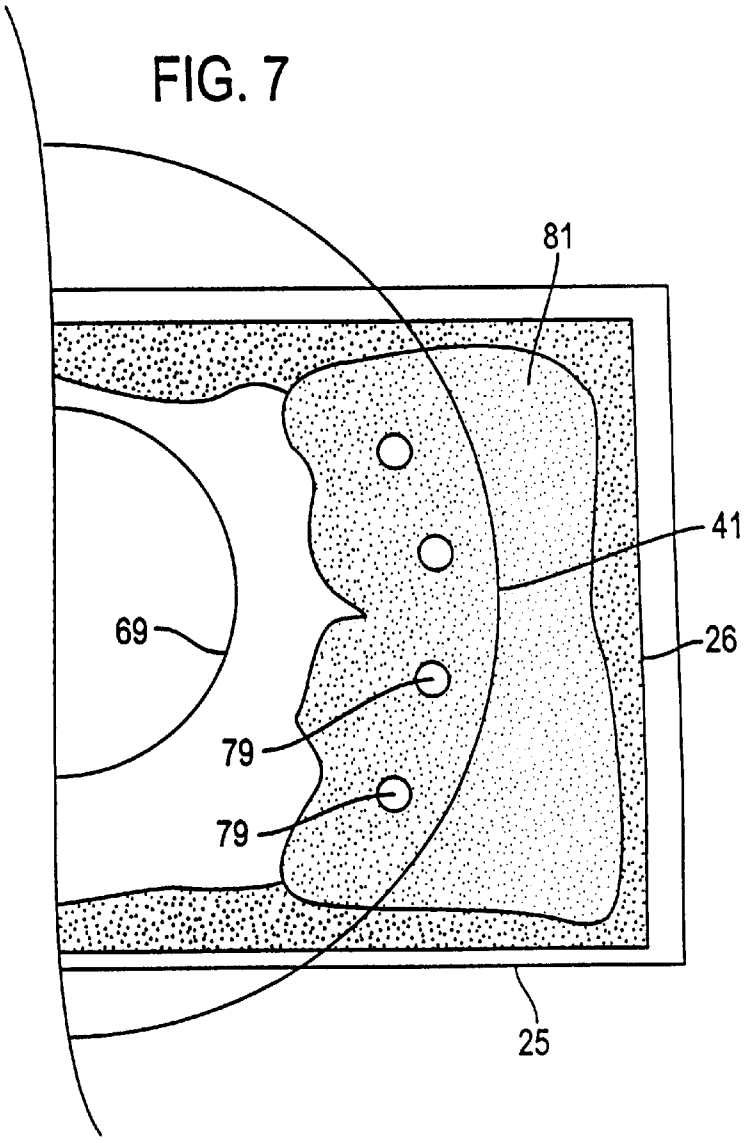
FIG. 7 is another overview similar to FIG. 6 showing another mode of the invention.

FIG. 6 shows a see-through view depicting the header flange 41, the top plate 25 outline and nipple plate 26 outline. The area of silver penetration between the plates 25 and 26 is shown as a stippled zone 71 with the area void of silver shown as zone 73. Since the area 73 void of silver penetration occurs on either side where the flange periphery 75 is welded to the top plate 25, material failure can occur in the zone 77. To solve this problem, referring to FIG. 7, circular holes 79 or other openings can be drilled into the nipple plate 26 to allow insertion of additional silver, thereby increasing penetration in the area where the flange periphery 75 meets the header top plate 25. Thus, premature fracture or failure can be avoided by reason of the strengthened bond between the nipple plate 26 and the header top plate 25. Of course, other ways to improve the top plate strength or support the plate 25 can be used to prevent failure in the top plate or other component of the header 3 as a result of header attachment. For example, the nipple plate could be evenly perforated to promote even more penetration of the brazing filer material or could include strengthening ribs in at least the zone 77.

When installing the inventive outboard marine heat exchanger 10, the mating flange 53 can be first welded or otherwise attached to the pipe stub 69 extending outwardly from the vessel hull 71. With the mating flange 53 secured to the pipe stub 69, the threaded studs 47 of the header flange 41 can then be inserted through the openings 63 in the mating flange 53, see FIG. 5. By reason of the clearance between the stud distal end 79 and the vessel hull outer surface 93, each of the washers 59 and 61 and lock nuts 57 can be threaded onto the studs 47 to secure the flange 53 to the header flange 41. There is no need to access the interior of the vessel to attach the heat exchanger to the vessel. The outboard marine heat exchanger is then ready for use for cooling the marine engine coolant. Of course, the mating flange could be first secured to the header flange and then attached to the pipe stub or other connector used to connect to the marine engine cooling system.

As such, an invention has been disclosed in terms of preferred embodiments thereof which fulfills each and every one of the objects of the present invention as set forth above and provides a new and improved outboard marine heat exchanger, header design and method of installation.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A heat exchanger comprising:

a) a plurality of cooling tubes arranged in a spaced apart relationship; and b) a pair of headers positioned at opposite ends of the plurality of cooling tubes, each header further comprising:

i) a manifold chamber having a first set of openings in communication with one end of each of the cooling tubes and a second opening adapted to communicate with engine cooling fluid; and ii) a header flange attached to a portion of the header and having a passageway therethrough to communicate with the manifold chamber and the engine cooling fluid, the header flange having a plurality of fastening components to facilitate connecting the heat exchanger to a marine vessel, wherein the header further comprises an end plate, a cooling tube interface plate, a pair of side plates, a bottom plate, a top plate and a nipple plate, the top plate having the second opening therein and the nipple plate having an opening aligned with the second opening.

2. A heat exchanger comprising:

a) a plurality of cooling tubes arranged in a spaced apart relationship; and b) a pair of headers positioned at opposite ends of the plurality of cooling tubes, each header further comprising:

i) a manifold chamber having a first set of openings in communication with one end of each of the cooling tubes and a second opening adapted to communicate with engine cooling fluid; and ii) a header flange attached to a portion of the header and having a passageway therethrough to communicate with the manifold chamber and the engine cooling fluid, the header flange having a plurality of fastening components to facilitate connecting the heat exchanger to a marine vessel, wherein the header includes a top plate having a second opening aligned with the passageway in the header flange and a nipple plate arranged adjacent and beneath the top plate, the nipple plate including a third opening aligned with the second opening and a plurality of throughholes, each throughhole located in the nipple plate at a zone coincident with a location where an outer periphery of the header flange aligns with the header flange.

3. The heat exchanger of claim 2, wherein the nipple plate and the header flange are joined by brazing.

4. A method of attaching a marine heat exchanger to a vessel hull comprising the steps of:

a) providing a marine vessel with at least a pair of pipe stubs extending therefrom;

b) attaching a mating flange to each pipe stub, the mating flange having an opening aligned with an opening in the pipe stub;

c) attaching a header flange of a marine heat exchanger to each mating flange, each header flange having an opening aligned with the opening of each pipe stub, and the marine heat exchanger including a pair of headers interconnected by cooling tubes, each header in communication the each opening in the header flange to provide communication between the heat exchanger cooling tubes and each pipe stub.

5. The method of claim 4, wherein the mating flange and the header flange are mechanically fastened together.

6. The method of claim 4, wherein the header flange is attached to the header by a metal fusion process.

7. A heat exchanger for use in connection with a marine vessel hull having at least two stubs extending therefrom, comprising:

a) a plurality of cooling tubes arranged in a spaced apart relationship; and b) a pair of headers positioned at opposite ends of said plurality of cooling tubes, each header further comprising:

i) a manifold chamber having a first set of openings in communication with one end of each of said cooling tubes and a second opening adapted to communicate with engine cooling fluid; and ii) a header flange extending from a portion of said header and having a passageway communicating with said manifold chamber and said engine cooling fluid, said header flange being adapted to be connected to a mating flange, which is adapted to be connected to said stubs, wherein said heat exchanger can be secured to said marine vessel hull using said stubs and said mating flange.

8. The heat exchanger of claim 7, wherein the header flange is secured to the header by metal fusion.

9. The heat exchanger of claim 7, wherein the passageway terminates at an edge coincident with a surface of the header flange configured to face the marine vessel hull.

10. The heat exchanger assembly of claim 7, further comprising at least one gasket disposed between the mating flange and the header flange to provide electrical insulation therebetween.

11. The heat exchanger assembly of claim 7, further comprising an electrically insulating washer arranged to electrically isolate the mating flange and the header flange.

12. The heat exchanger of claim 7, wherein said header flange has a plurality of fastening components arranged to mate with a plurality of fastening components on said mating flange to connect said header flange to said mating flange.

13. The heat exchanger of claim 12, wherein each fastening component of the header flange comprises a threaded stud extending from the header flange.

14. The heat exchanger of claim 12, wherein the fastening components of the header flange are arranged to surround the passageway.

15. The heat exchanger of claim 4, wherein the fastening components of the header flange are arranged concentrically around the passageway.

16. The heat exchanger of claim 13, wherein each threaded stud extends within the header flange a distance less the thickness of the header flange.

17. The heat exchanger assembly of claim 12, comprising an electrical insulator between each of the fastening components of the header flange and each of the fastening components of the mating flange.

18. The heat exchanger assembly of claim 12, wherein each fastening component of the header flange comprises a threaded stud extending from the header flange, the mating flange has a throughopening for each threaded stud, and each fastening component of the mating flange comprises a nut sized to thread onto the stud for securing the mating flange to the header flange.

19. The heat exchanger assembly of claim 12, further comprising a tubular member attached to the mating flange and positioned to be aligned with the passageway of the header flange when the fastening components of the mating flange mate with the fastening components of the header flange, the tubular member being adapted to communicate with the engine cooling fluid.

20. The heat exchanger assembly of claim 19, wherein the tubular member is adapted to be attached to a marine vessel hull and has a length that allows access to the fastening components of the header flange and mating flange.

* * * * *